US006224343B1

(12) United States Patent
Newcomer

(10) Patent No.: US 6,224,343 B1
(45) Date of Patent: May 1, 2001

(54) AUTOMATED, AIR-OPERATED BELLOWS PUMPS FOR GROUNDWATER SAMPLING AND OTHER APPLICATIONS

(76) Inventor: Kevin L. Newcomer, 13734 Shady La., Monroe, MI (US) 48161

( * ) Notice: Subject to any disclaimer, the term of this patent is extended or adjusted under 35 U.S.C. 154(b) by 0 days.

(21) Appl. No.: 09/370,729

(22) Filed: Aug. 9, 1999

Related U.S. Application Data

(60) Provisional application No. 60/095,896, filed on Aug. 10, 1998.

(51) Int. Cl.[7] ..... F04F 1/06

(52) U.S. Cl. ..... 417/118; 417/131; 417/137; 417/472

(58) Field of Search ..... 417/118, 131, 417/137, 140, 394, 472; 92/34, 43

(56) References Cited

U.S. PATENT DOCUMENTS

| | | | | |
|---|---|---|---|---|
| 2,807,215 | * | 9/1957 | Hawxhurst | 417/394 |
| 3,749,526 | * | 7/1973 | Ferrentino | 417/394 |
| 3,938,910 | | 2/1976 | Douglas . | |
| 4,104,005 | | 8/1978 | Poirier . | |
| 4,257,751 | | 3/1981 | Kofahl . | |
| 4,295,801 | | 10/1981 | Bennett . | |

(List continued on next page.)

FOREIGN PATENT DOCUMENTS

| | | | | |
|---|---|---|---|---|
| 19631533 A1 | * | 1/1998 | (DE) | 200/404 |
| 57-153978 | * | 9/1982 | (JP) | 417/472 |

*Primary Examiner*—Charles G. Freay
*Assistant Examiner*—Cheryl J. Tyler
(74) *Attorney, Agent, or Firm*—Gifford, Krass, Groh, Sprinkle, Anderson & Citkowski, PC

(57) ABSTRACT

An air-operated pump for groundwater sampling features a corrugated bellows as opposed to the traditional bladder used for fluid collection. The preferred embodiment includes an air-supply line and a fluid-discharge line, each coupled to the pump body through a controller disposed at an appropriate above-ground location. The bellows is operable between a refill state, wherein fluid is drawn into the pump body through the fluid inlet, and a discharge state wherein fluid is forced out of the pump body through the discharge line. An apparatus disposed within the pump body governs the air received through the air-supply line to, at least, semi-automatically cycling the bellows between the refill and the discharge states. To assist in cycling, the pump may further include one or more magnets for latching the bellows in the refill or discharge state, and an electrical sensor for detecting whether or not the bellows is latched. As an alternative, the apparatus for governing the air received through the air-supply line may include a valve in the air-supply line which is mechanically coupled to the bellows. A separate exhaust line may also be provided to expel air received through the air-supply line, in which case the apparatus for governing the air received through the air-supply line also governs the air expelled through the exhaust line.

12 Claims, 6 Drawing Sheets

U.S. PATENT DOCUMENTS

| | | | | |
|---|---|---|---|---|
| 4,438,654 | | 3/1984 | Torstensson . | |
| 4,489,779 | | 12/1984 | Dickinson et al. . | |
| 4,585,060 | | 4/1986 | Bernardin et al. . | |
| 4,727,936 | | 3/1988 | Mioduszewski et al. . | |
| 4,749,337 | * | 6/1988 | Dickinson et al. | 417/394 |
| 4,807,707 | | 2/1989 | Handley et al. . | |
| 4,822,257 | | 4/1989 | Olofsson | 417/389 |
| 4,844,797 | | 7/1989 | Wells . | |
| 4,869,397 | | 9/1989 | Corniea et al. . | |
| 4,886,428 | * | 12/1989 | Olofsson | 417/389 |
| 4,886,432 | | 12/1989 | Kimberlin . | |
| 5,004,405 | | 4/1991 | Breslin | 417/131 |
| 5,027,902 | | 7/1991 | Dickinson et al. | 166/369 |
| 5,141,404 | | 8/1992 | Newcomer et al. | 417/130 |
| 5,147,185 | | 9/1992 | Niehaus et al. . | |
| 5,228,840 | * | 7/1993 | Swank | 417/118 |
| 5,261,791 | | 11/1993 | Goguen . | |
| 5,373,897 | | 12/1994 | Skarvan . | |
| 5,411,381 | * | 5/1995 | Perrodin | 417/472 |
| 5,509,479 | | 4/1996 | Emmons . | |
| 5,549,157 | * | 8/1996 | Johnson et al. | 417/40 |
| 5,611,672 | * | 3/1997 | Modesitt | 417/140 |
| 5,803,137 | * | 9/1998 | Shimotoyodome et al. | 141/67 |
| 5,927,955 | | 7/1999 | Janesky . | |

* cited by examiner (REFILL MODE)

(DISCHARGE MODE)

(REFILL MODE)

(DISCHARGE MODE)

(REFILL MODE)

(DISCHARGE MODE)

(REFILL MODE)

(DISCHARGE MODE)

AUTOMATED, AIR-OPERATED BELLOWS PUMPS FOR GROUNDWATER SAMPLING AND OTHER APPLICATIONS

REFERENCE TO RELATED APPLICATIONS

This application claims priority of U.S. provisional patent application Ser. No. 60/095,896, filed Aug. 10, 1998, the entire contents of which are incorporated herein by reference.

FIELD OF THE INVENTION

This invention relates generally to pumps for groundwater sampling and the like, and, more particularly, to automated air-operated bellows pumps for groundwater sampling and other applications.

BACKGROUND OF THE INVENTION

There does exist many types of submersible pumps for groundwater sampling and other uses. FIG. 1 shows, generally at 100, a typical prior-art configuration. Since devices of this kind are inserted down well holes, the unit consists of an outer cylindrical pump body 102, typically constructed of stainless steel. The body includes a lower inlet end 104 and an upper outlet end 106. An internal cylindrical bladder 108, typically constructed of Teflon, partitions the interior of the pump body 102 into a gas-carrying section 110, and a fluid-carrying section 112 within the bladder 108.

A tube 114 having, perforations 116, is generally positioned within the fluid-carrying section 112, as shown. A lower check valve 120 is provided at the lower inlet end 104 to permit groundwater or like fluids to pass through the lower end 104 and into the tube 114 and fluid-carrying chamber 112 through perforations 116. The check valve 120 also prevents the fluid from backflowing through the lower inlet 104. An upper check valve 122 allows fluid from the fluid-carrying chamber 112 to be discharged through the upper end 106 by passing through apertures 116 and into the tube 114. The upper check valve 122 also prevents the fluid from backflowing down into the pump interior.

Above ground, a controller 130 is provided having a conduit 132 in pneumatic communication with the gas-carrying section 110 within the pump body 102. The apparatus operates by pressurizing and venting the gas within the chamber 110, thereby compressing and expanding the bladder 108, which is quite flexible, thereby forcing fluid within the chamber 112 out the upper end 106 through tube 114 by way of apertures 116. More particularly, when the pump body is submerged, ground water or other fluid flows into the chamber 112 through tube 114 having apertures 116 through the lower end 104, bypassing check valve 120 due to natural hydrostatic pressure.

When an actuating gas such as compressed air is driven through conduit 132 and into the gas-carrying section 110, the bladder 108 is compressed and the lower check valve 120 is forced against the opening 104, thereby forcing the fluid contained within the fluid-carrying section upwardly and out through the upper opening 106, displacing check valve 122 in its path. The gas-carrying chamber 110 is then vented at ground level through controller 130, permitting a fresh charge of ground water to again fill the fluid-carrying chamber 112 and tube 114 through perforations 116, at which time another cycle may be started by compressing the bladder 108.

Although a single controller 130 may be configured to control a multiplicity of similar pumps, the timing sequences for each pump must be optimized and stored to ensure the most efficient operation for each sampling station. The timing/cycling means within the controller therefore typically includes a 3-way valve associated with each pump to which it is connected. The 3-way valve is alternatively actuated and de-actuated to produce a pulsating flow to the bladder of each pump, wherein a compressed gas is applied via each conduit 132, on which the 3-way valve changes state, enabling the gas contained within chamber 110 to be vented to atmosphere. The controller 130 must therefore include electronic, pneumatic or mechanical timing devices associated with each 3-way valve, in each pump, to ensure proper operation thereof.

Although the configuration just described is capable of operating without human intervention after an initial parameter-setting phase, the pump is not really self-cycling, since the controller 130 must be programmed to alternately pressurize and vent the gas-carrying chamber 110 through the single pneumatic path 132. In addition, the efficiency of the device is dictated by large measure to the depth of the pump, since the hydrostatic pressure at a given level affects the extent to which the fluid-carrying chamber is refilled in accordance with each cycle.

The deeper the pump, the longer must be the pneumatic conduit 132, requiring a greater degree of pressurization through controller 130 to bring about the most efficient cycling. Even though the control parameters may be entered and altered through the controller 130, the need still remains for a pump configuration which may be used for groundwater sampling operations which is conducive to further levels of automation. Ideally, such a pump should be self-cycling without the need for sophisticated above-ground control mechanisms.

SUMMARY OF THE INVENTION

This invention resides in an air-operated pump for groundwater sampling and other applications. In contrast to existing configurations, pumps according to the invention feature a collapsible bellows as opposed to the traditional bladder used for fluid collection. The use of a bellows offers a number of advantages over conventional designs, including the potential for truly automatic operation, wherein continuous cycling is maintained without necessarily relying on an above-ground controller to precisely time out the charge and discharge portions of each cycle.

Apparatus according to the invention includes a non-corrosive submersible pump body having a fluid inlet. The preferred embodiment includes an air-supply line and a fluid-discharge line, each coupled to the pump body through a controller disposed at an appropriate above-ground location. A bellows having a closed end and an open end is disposed within the pump body. Although a corrugated-type of bellows is shown and described with reference to the drawings, other types of bellows configurations, including convoluted bellows may alternatively be employed. The bellows is operable between a refill state, wherein fluid is drawn into the pump body through the fluid inlet, and a discharge state wherein fluid is forced out of the pump body through the discharge line. Means disposed within the pump body govern the air received through the air-supply line, thereby at least semi-automatically cycling the bellows between the refill and discharge states.

The bellows may be compressed during the refill state and expanded during the discharge state, or expanded during the refill state and compressed during the discharge state. The open end of the bellows may be oriented upwardly or downwardly when the pump is submersed, though the former is preferred since gas trapped in the bellows may naturally escape upwardly and out of the pump body.

To assist in cycling, a pump according to the invention may further include one or more magnets for latching the bellows in the refill or discharge state. As such, the means for governing the air received through the air-supply line may include an electrical sensor such as a reed switch for detecting whether or not the bellows is latched. As an alternative, the means for governing the air received through the air-supply line may include a valve in the air-supply line which is mechanically coupled to the bellows. A separate exhaust line may also be provided to expel air received through the air-supply line, in which case the means for governing the air received through the air-supply line also preferably governs the air expelled through the exhaust line.

DETAILED DESCRIPTION OF THE INVENTION

Figure 1:
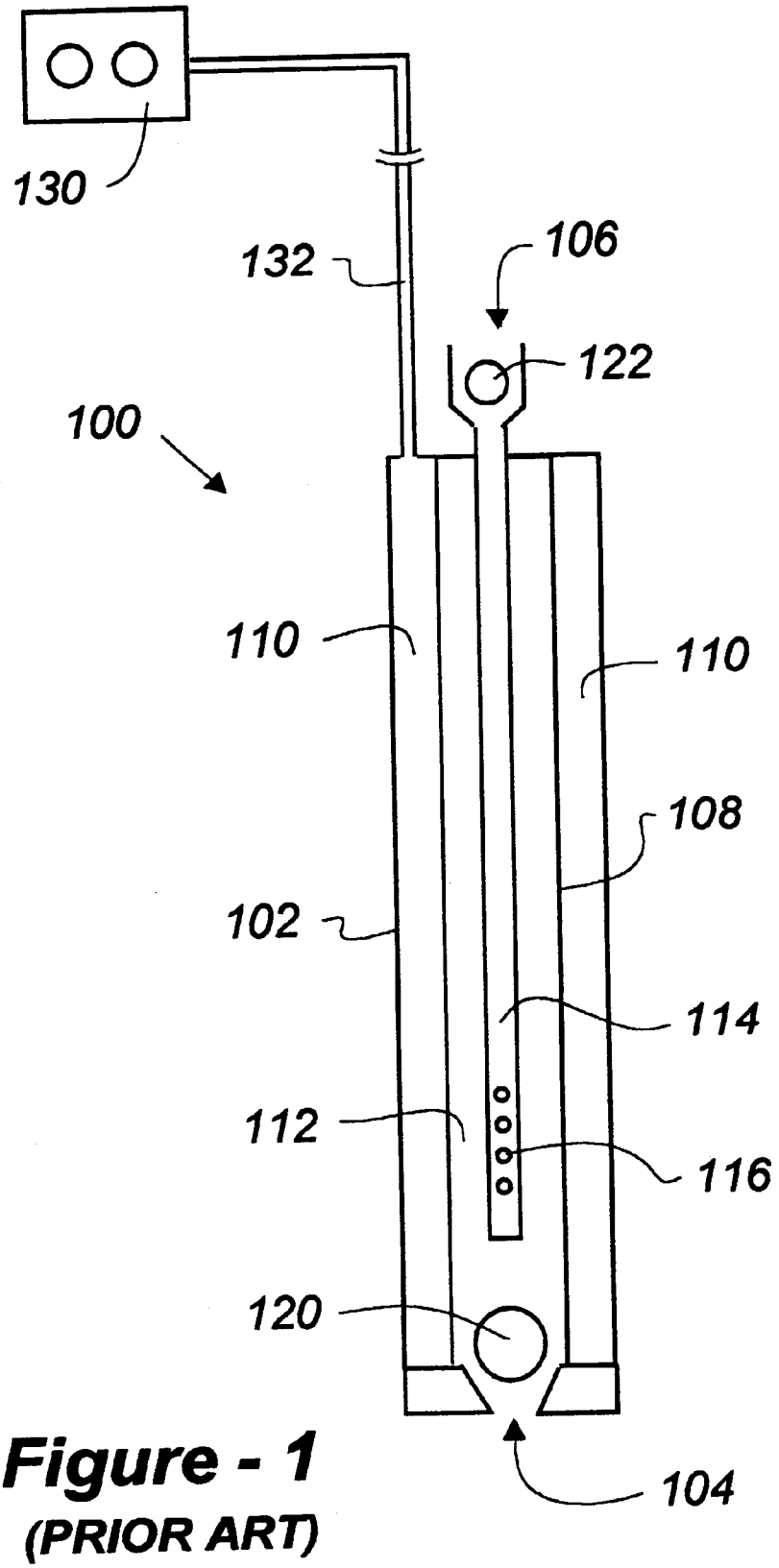
Figure - 1 (PRIOR ART)
FIG. 1 is a simplified drawing of a prior-art, air-operated groundwater pump wherein a thin-walled bladder is alternatively compressed and vented to atmosphere.

In broad and general terms, the present invention improves upon pumps of the type used for groundwater sampling, including the removal of gasoline or other hazardous materials, by providing a collapsible bellows as opposed to the traditional bladder used for fluid collection. The substitution of a bellows over a flexible bladder offers a number of advantages over conventional designs, including the potential for truly automatic operation; that is, continuous cycling without necessarily relying on an above-ground controller to precisely time out the charge and discharge portions of each cycle.

In terms of a truly automatic configuration, reference is made to FIGS. 2A through 4B, which illustrate the preferred embodiment of a sampling pump according to the invention. The pump is interfaced to a regulated air supply providing a uniform pressurization through an air-supply line. This pressurization effectuates an automatic, continuous cycling between a refill mode (FIG. 2A) and a discharge mode of operation (FIG. 2B). Before proceeding with a detailed description of the operation of the pump of FIGS. 2A through 4B, the various component parts will first be identified.

The internal workings of the pump are contained within a pump body 202 constructed of a corrosion-resistant material such as stainless steel. A pump head section 204 contains feedthroughs to the air-supply line 206 and the exhaust line 208. The air-supply and exhaust lines are in communication with an air-supply and exhaust valve assembly 210, including a pair of latch magnets 212, the operation of which will be better understood with reference to FIGS. 3A and 3B. The lower of the latch magnets 212 is adhered to a rocking plate 214 which, in turn, is interconnected to a de-actuation rod 216. An actuation plunger 218 rides on the de-actuation rod 216, and a de-actuation spring 220 is preferably provided directly beneath the actuation plunger 218, as shown. Note that although reference is made to "Fair" in this detailed description, any other gas may be substituted.

The actuation plunger 218 interconnects to a corrugated bellows 222 which is preferably constructed of Teflon or other inert yet flexible material, as appropriate. An air displacement rod 224 is disposed within the bellows 222. An inlet screen 230 is disposed at the bottom end of the pump body 202. The inlet screen 230 is in fluid communication with a pump inlet having an inlet checkball 232 disposed within a main path 234 in fluid communication with the interior of the bellows 222. A subsidiary path 236 interconnects to a discharge line 238 including a discharge checkball 240. Although checkballs are shown, it will be apparent to one of skill in the art that other cyclable sealing means may be used, including flap valves, and so forth.

Figure 3A:
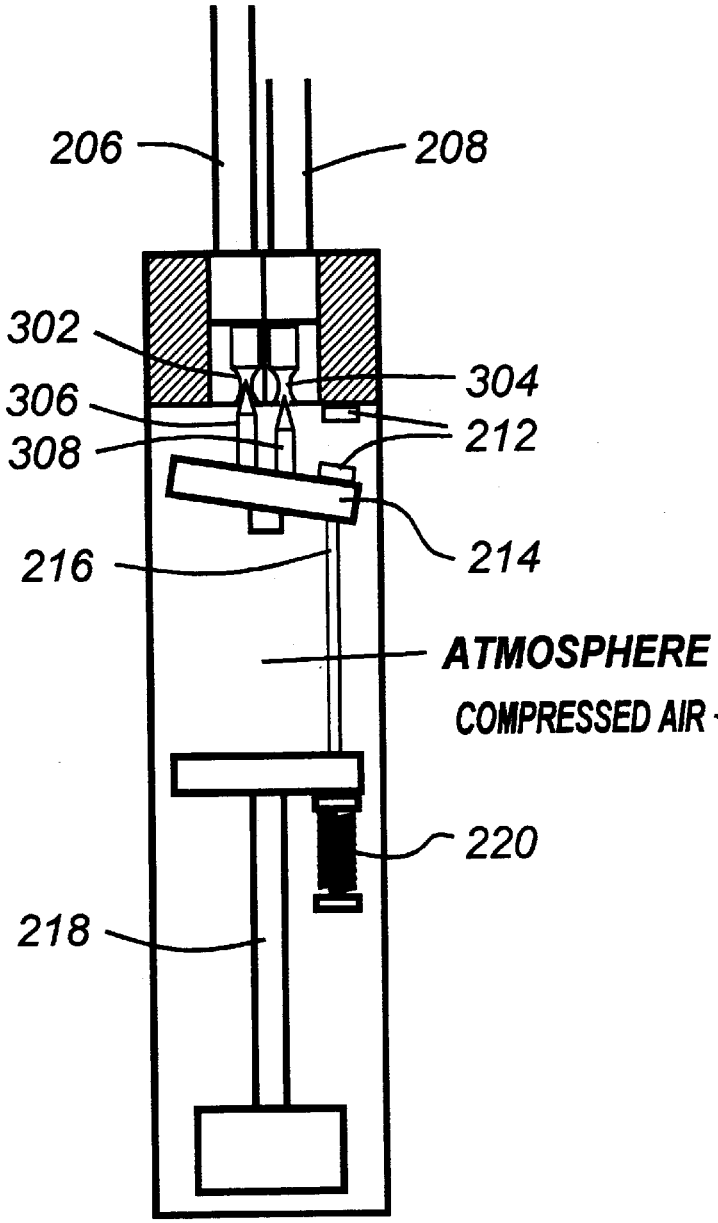
FIG. 3A is a more detailed drawing of the valve assembly of the pump of FIGS. 2A and 2B with respect to the refill mode.
Figure 3B:
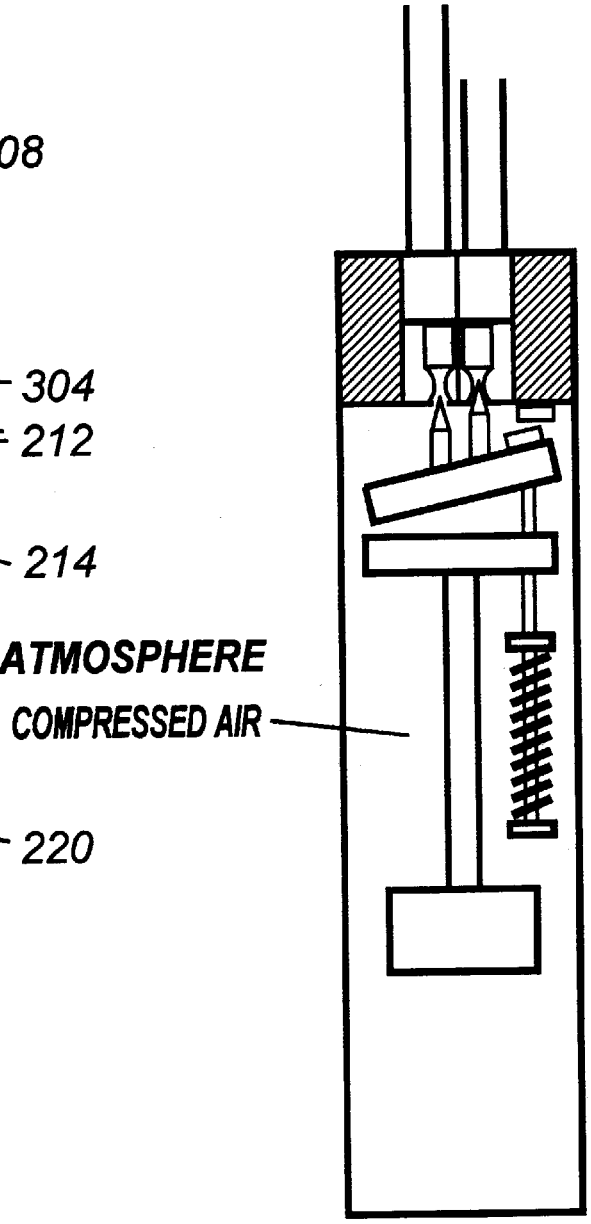
FIG. 3B is a detailed drawing of the valve assembly of the pump of FIGS. 2A and 2B with respect to the discharge mode.

FIGS. 3A and 3B provide additional details of the air supply and exhaust valve assembly 210 with respect to refill and discharge modes of operation, respectively. These figures illustrate, in greater detail, the use of an adjustable air-supply seat 302, and a corresponding adjustable exhaust seat 304. An air-supply stem 306 moves into, and away from the air supply seat 302, whereas an exhaust stem 308 moves into, and away from the exhaust seat 304. The air-supply and exhaust stems 306 and 308 are interconnected to rocking plate 214, which is pivotally interconnected to the de-actuation rod 216 and de-actuation rod 220.

Figure 2A:
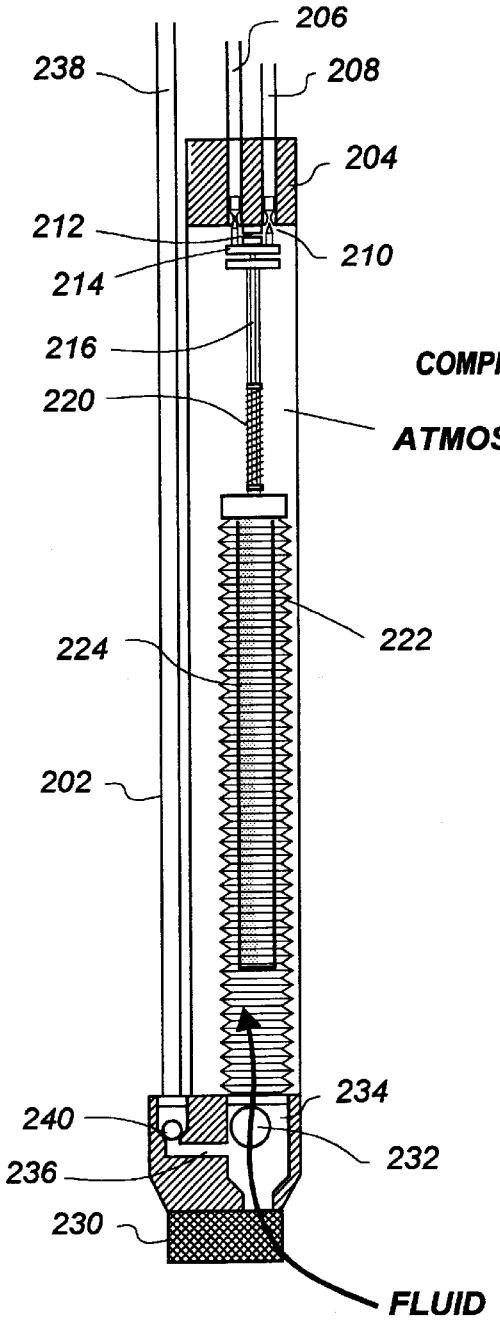
FIG. 2A is a drawing of an automatic groundwater sampling pump according to the invention during a refill mode.
Figure 2B:
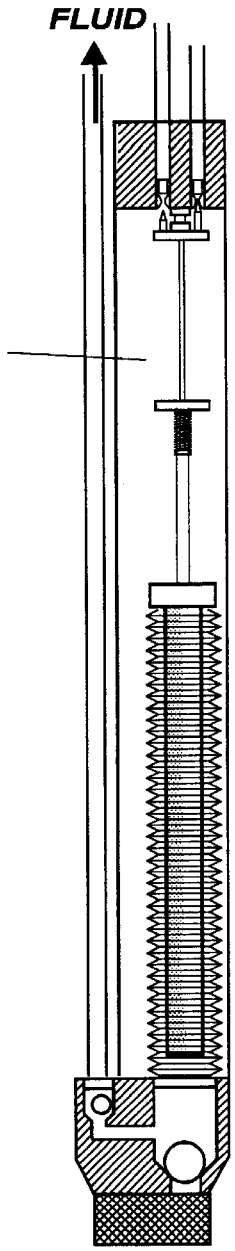
FIG. 2B is a drawing of the pump of FIG. 2A during a discharge mode.

The pump operates as follows, assuming that the bellows 222 is filled with fluid. As shown in FIG. 2A, the air-supply and exhaust valve assembly is initially latched, held in place by the latch magnets 212. In this position, the air-supply valve, consisting of seat 302 and stem 306, is open, whereas the exhaust valve, consisting of seat 304 and stem 308, is closed. When supplied with compressed air through supply line 206, the bellows 222 is forced to contract downwardly as the actuation plunger 218 is forced away from the pumphead 204. The fluid trapped inside the bellows forces the inlet checkball 232 to seat, as shown in FIG. 2B. The discharge checkball 240 is caused to unseat, and fluid passes up and out of the pump through the discharge line 238.

When the bellows 222 reaches the end of its stroke, the de-actuation rod 216 is pulled downwardly, compressing the de-actuation spring 220. This forces the valve assembly 210 to pivot, closing the air supply valve while simultaneously opening the exhaust valve, as shown in FIG. 3A. The optional de-actuation spring 220 may be used to ensure that the valve assembly pivots rapidly, thereby eliminating the possibility that the valve mechanism only shifts partially, which might cause the pump to stall.

With the release of the compressed air through the exhaust valve, the bellows 222 expands upwardly due to a combination of head pressure and the natural spring force formed in the bellows material. Note that this force may be enhanced with the addition of a coil spring located internally or externally of the bellows. As the bellows expands upwardly, the suction created inside the bellows seats the discharge checkball, trapping fluid in the discharge line, initiating the refill mode, as shown in FIGS. 2A and 3A. This action unseats the inlet checkball 232, and draws fluid inwardly. When the bellows reaches its upward stroke, the actuation rod again pivots the air control mechanism. The magnets attract each other, latching the valve assembly in the position shown in FIG. 2A. The air supply valve is reopened, the exhaust valve is closed, and the process automatically repeats as described above.

One drawback of the arrangement just described is that with the opening of the bellows at the downward end, air may become trapped within the bellows, preventing a full volume of fluid expelled per stroke. This problem may be solved in various ways, for example, by providing a bleed at the top of the bellows to bleed off the trapped air, or through the provision of a valve or other such mechanism. However, solutions of this kind tend to be mechanically problematic.

Figure 4A:
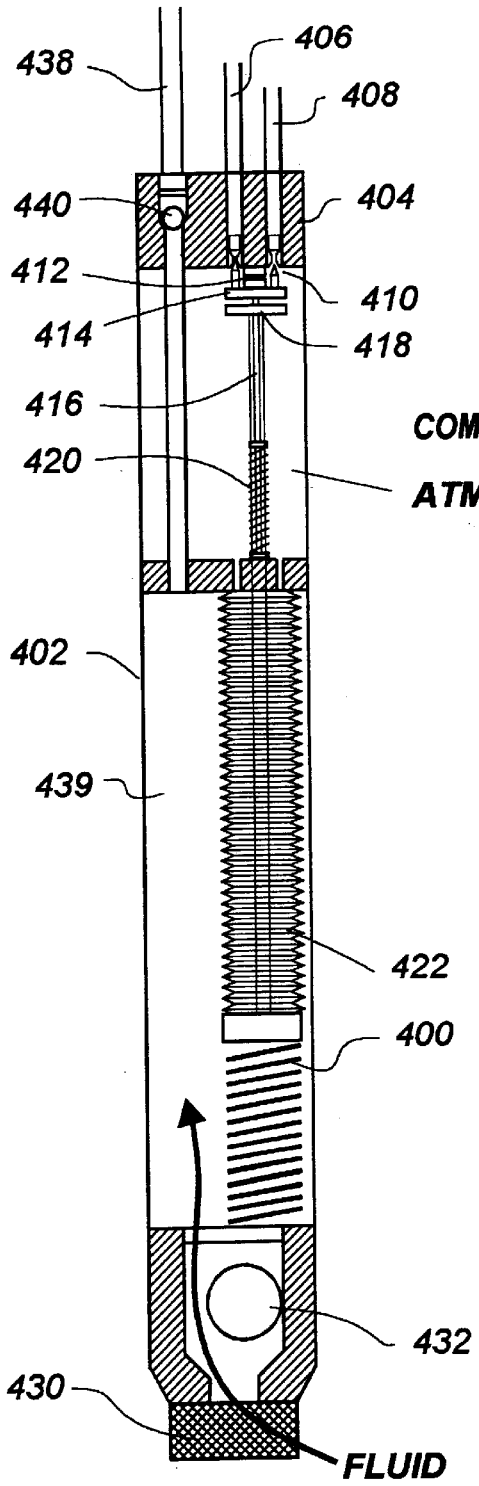
FIG. 4A is an alternative automatic groundwater sampling pump according to the invention, wherein the bellows is inverted relative to the pump of FIGS. 2 and 3, and in a refill mode.
Figure 4B:
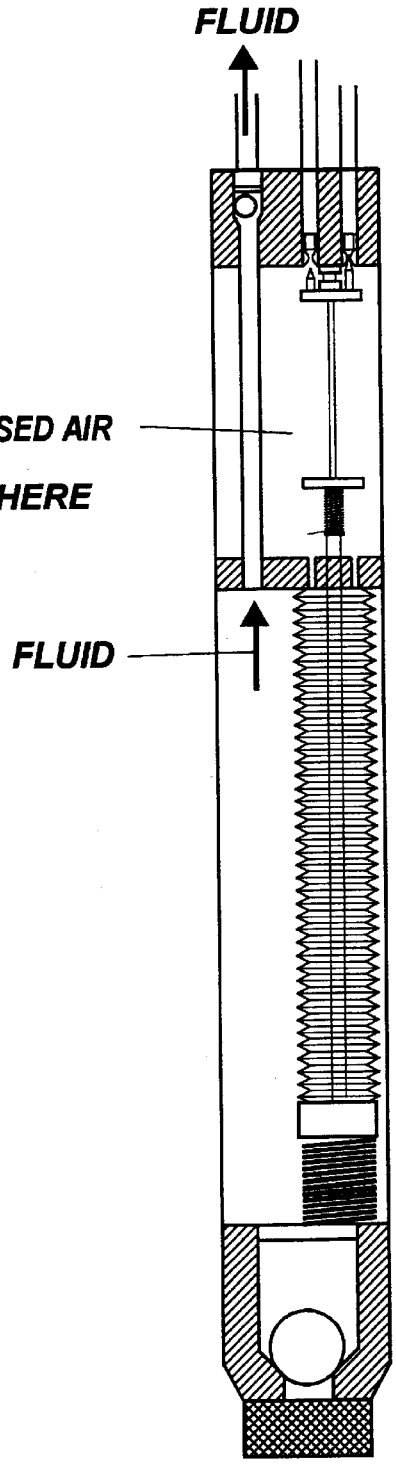
FIG. 4B is a drawing of the pump of FIG. 4A with respect to a discharge mode of operation.

FIGS. 4A and 4B depict an alternative configuration, similar to that of FIGS. 2A through 3B, except that the bellows is "inverted," enabling trapped air to naturally rise and escape through the top opening. With the exception of a corrosion-resistant (i.e., stainless steel) return spring 400 and the inverted nature of the bellows 422, the configuration of FIGS. 4A and 4B includes many of the same components as shown in the non-inverted configuration. Although the return spring 400 is shown in the liquid chamber, the spring may alternatively be positioned in the air chamber. Indeed, the air-supply and exhaust valve assembly may function substantially similarly to the configuration described with reference to FIGS. 3A and 3B, but with certain differences. For example, although the configuration of FIGS. 4A and 4B include an inlet screen 430 interfaced to an inlet checkball 432, the discharge line 438 need not extend all the way down to the lower portion of the pump inlet, but may, instead, communicate to the fluid-filled cavity 439 with the discharge checkball 440 being positioned proximate the pump head 404.

The operation of the arrangement of FIGS. 4A and 4B will now be described, assuming that fluid exists outside the bellows 422 within fluid-filled cavity 439. The air-supply and exhaust valve assembly is initially latched, held in place by the latch magnets. In this position, the air supply valve is open and the exhaust valve is closed. When supplied with compressed air, the bellows 422 is forced to expand downwardly. The compression of the fluid trapped outside the bellows forces the inlet checkball 432 to seat, and the discharge at checkball 440 to unseat, thereby allowing the fluid to pass upwardly through the discharge line 438.

When the bellows reaches the end of its stroke, the de-actuation rod is pulled downwardly, compressing the de-actuation spring, forcing the valve assembly to pivot, thereby closing the air-supply valve while simultaneously opening the exhaust valve. As with the embodiment of FIGS. 2A and 2B, the de-actuation spring ensures that the valve assembly pivots rapidly so as to eliminate any possibility of the valve mechanism only shifting partially, which might cause the valve to stall.

With the release of the compressed air through the exhaust valve, the bellows contracts upwardly due to the expansion of the return spring 400. As the bellows contracts upwardly, the suction created inside the pump seats the discharge checkball 440, trapping fluid in the discharge line 438, which, in turn, simultaneously unseats the inlet ball, and draws fluid upwardly into the pump body. At the end of the upward stroke of the bellows, the air control mechanism pivots, and the magnets attract, latching the valve assembly in its original position. The air-supply valve is reopened, and the exhaust valve is again simultaneously closed, enabling the process to repeat.

Figure 5A:
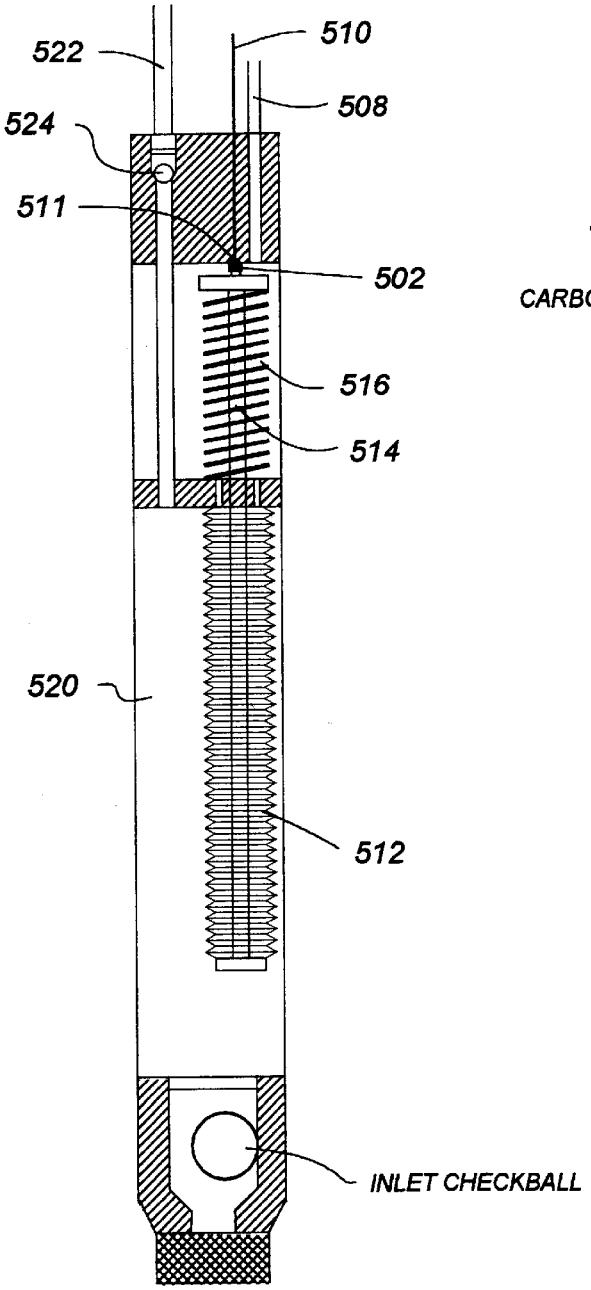
FIG. 5A is a drawing of a semi-automatic bellows-operated groundwater-sampling pump according to the invention in a refill mode.
Figure 5B:
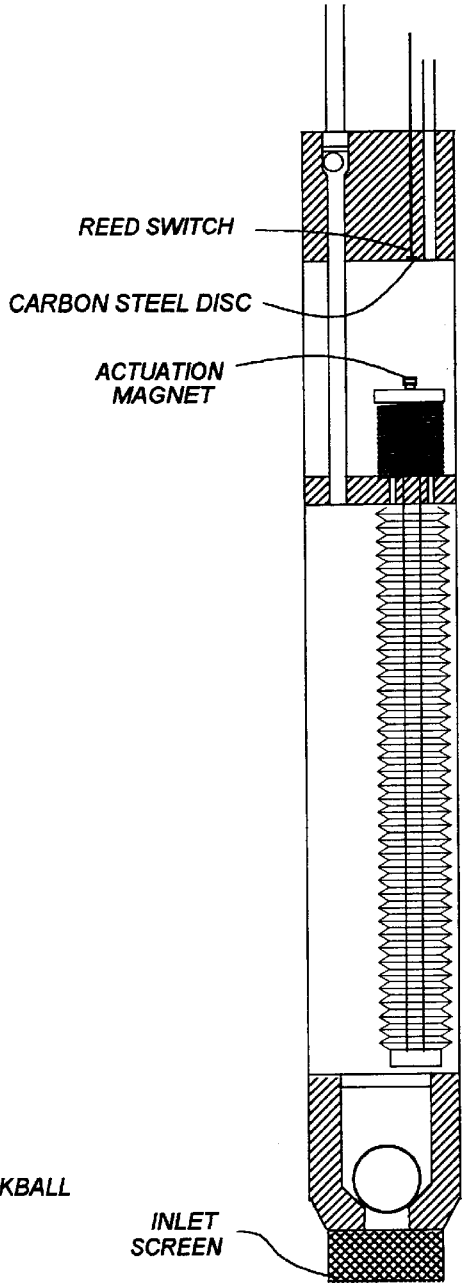
FIG. 5B is a drawing of the pump of FIG. 5A during a discharge mode of operation.
Figure 5C:
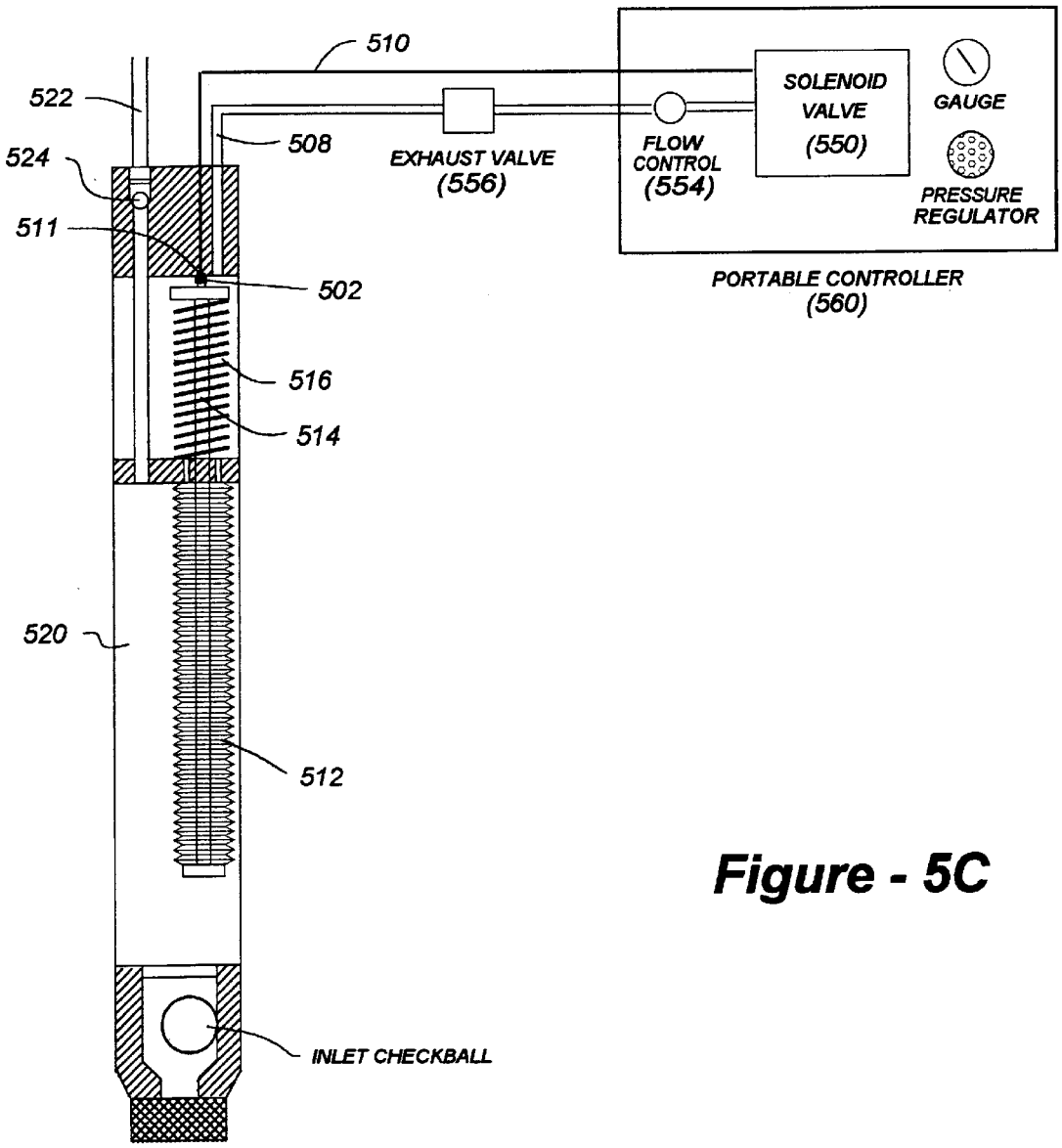
FIG. 5C illustrates the pump of FIGS. 5A and 5B with attachments to a portable controller according to the invention.

FIGS. 5A through 5C illustrate an alternative embodiment of the invention, wherein a return spring is located above the bellows when the pump is properly submersed. This embodiment may be considered "semi-automatic," in the sense that it utilizes a reed switch to detect the latching activity of the magnet as opposed to an air-supply and exhaust valve assembly. This embodiment obviates the need for a separate exhaust line while, at the same time, requires less adjustment than existing units wherein both the fill and refill cycles must be carefully controlled above ground.

FIG. 5A shows this pump configuration in a refill mode, wherein an actuation magnet 502 is coupled to the pump head 504, as shown. The reed switch, interconnected through line 510 which extends through the pump head, is able to sense when the magnet 502 is coupled or uncoupled from the pump head. The bellows 512 is preferably inverted, allowing trapped gas to escape. Within the bellows 512, there is disposed an actuation plunger 514 terminating in an upper plate to provide for a return spring 516, preferably of a non-corrosive material such as stainless steel. The fluid-carrying chamber 520, which is fed from an inlet screen and inlet checkball below, is in communication with the discharge line 522 through a discharge checkball 524.

The reed switch 511 detects magnet contact, and feeds this information to an air-supply line through a controller, best seen in FIG. 5C. After the chamber 520 has been filled with fluid, the reed switch communicates a signal internal to the controller, causing the air to pressurize the inside of the bellows 512. When the bellows is near to the end of its stroke, this action pulls the actuation magnet 502 away from the pump head. This position is sensed by the reed switch, interrupting the air supply. This allows the return spring to force the magnet back against the pump head, drawing the next charge of fluid into the chamber 520 past the inlet screen, pump inlet and inlet checkball.

Note that although the configuration shown in FIGS. 5A through 5C have the bellows inverted, allowing gas to naturally escape out from the pump, it will be apparent to one of skill in the art, having been presented with this detailed description, that the apparatus may be turned around; that is, with the open end of the bellows oriented downwardly, as shown, for example, in FIG. 2A through 2C.

FIG. 5C shows the controller associated with the pump of FIGS. 5A and 5B. The reed switch line 510 interconnects to a solenoid valve 550 in the controller 560. The valve controls the flow of air and exhaust through the single line 508 through a flow controller 554 and an exhaust valve 556. Although this particular embodiment does require the reed switch and sensing line, once set up, the pump does not require further adjustment, in the sense that a user need only dial in a desired air pressure, after which a predetermined determined level of pump cycling will automatically occur. The reed switch and sensing line may be removed according to an alternative environment, in which case a pneumatic frequency generator would be used in the controller. In addition, although the return spring is shown externally of the bellows in FIGS. 5A and 5B, the spring may be alternatively positioned within the bellows.

Having described my invention, I now claim:

1. An air-operated pump for groundwater sampling and other applications, comprising:

a submersible pump body having a fluid inlet;

an air-supply line and a fluid-discharge line, each coupled to the pump body from an above-ground location;

a corrugated bellows disposed within the pump body, the bellows having a closed end and an open end, the bellows being operable between a refill state, wherein fluid which surrounds the pump body when submerged is drawn into the pump body through the fluid inlet, and a discharge state wherein fluid is forced out of the pump body to the above-ground location through the discharge line; and apparatus disposed within the pump body and coupled to the closed end of the bellows for governing the air received through the air-supply line, thereby cycling the pump between the refill and discharge states.

2. The pump of claim 1, wherein the bellows is compressed during the refill state and expanded during the discharge state.

3. The pump of claim 1, wherein the open end of the bellows is oriented upwardly when the pump is submersed.

4. The pump of claim 1, wherein the apparatus disposed within the pump body for governing the air received through the air-supply line includes one or more magnets for latching the bellows in the refill or discharge state.

5. The pump of claim 1, wherein the apparatus disposed within the pump body for governing the air received through the air-supply line includes an electrical sensor for detecting whether or not the bellows is latched.

6. The pump of claim 5, further including a valve in the air-supply line which is mechanically coupled to the bellows.

7. The pump of claim 1, further including a separate exhaust line to expel air received through the air-supply line.

8. The pump of claim 7, wherein the apparatus disposed within the pump body for governing the air received through the air-supply line also governs the air expelled through the exhaust line.

9. An air-operated pump for groundwater sampling and other applications, comprising:

a submersible pump body having a fluid inlet;

an air-supply line, an exhaust line, and a fluid-discharge line, each line being coupled to the pump body from an above-ground location;

a corrugated bellows disposed within the pump body, the bellows having a closed end and an open end, the bellows being operable between a refill state, wherein fluid which surrounds the pump body when submerged is drawn into the pump body through the fluid inlet, and a discharge state, wherein fluid is forced out of the pump body through the discharge line; and a valve assembly mechanically coupled to the bellows within the pump body, the valve assembly being operative to automatically cycle the pump given a uniform pressurization through the air-supply line by performing the following functions:

a) closing the air-supply line and opening the exhaust line in conjunction with the refill mode, and b) opening the air-supply line and closing the exhaust line in conjunction with the discharge mode.

10. The pump of claim 9, wherein the bellows is compressed during the refill state and expanded during the discharge state.

11. The pump of claim 9, wherein the open end of the bellows is oriented upwardly when the pump is submersed.

12. The pump of claim 9, further including one or more magnets for latching the bellows in the refill or discharge state.

* * * * *